United States Patent [19]

Rodrigues

[11] 3,938,392

[45] Feb. 17, 1976

[54] PIPETTE

[75] Inventor: John J. Rodrigues, Orinda, Calif.

[73] Assignee: Rodrigues Associates, Inc., Oakland, Calif.

[22] Filed: Sept. 20, 1973

[21] Appl. No.: 398,956

Related U.S. Application Data

[63] Continuation of Ser. No. 3,398, Jan. 16, 1970, abandoned.

[52] U.S. Cl. ..... 73/425.6

[51] Int. Cl.[2] ..... B01L 3/02

[58] Field of Search ..... 73/425.4, 425.6; 222/215

[56] References Cited

UNITED STATES PATENTS

| | | | |
|---|---|---|---|
| 1,791,829 | 2/1931 | McCrackan | 73/425.4 P |
| 3,012,695 | 12/1961 | Lerner | 222/215 |
| 3,141,336 | 7/1964 | Oates | 73/425.4 P |
| 3,177,723 | 4/1965 | Pedersen | 73/425.4 P |
| 3,295,523 | 1/1967 | Weichselbaum | 128/232 |

FOREIGN PATENTS OR APPLICATIONS

| | | | |
|---|---|---|---|
| 27,608 | 8/1905 | United Kingdom | 73/425.6 |

*Primary Examiner*—S. Clement Swisher

[57] ABSTRACT

A pipette involving a tube of plastic having a discharge end and a bulb of flexible plastic integrally united with the tube toward its opposite end. The tube preferably extends into the bulb a way, to permit overflow, whereby to establish a fixed volume equal to the volume of the tube. By making the bulb of clear or translucent plastic, activity within the bulb may be observed and controlled.

11 Claims, 4 Drawing Figures

INVENTOR.
JOHN J. RODRIGUES

BY
Edward Brosler
Attorney

PIPETTE

This is a continuation of application Ser. No. 3398, filed Jan. 16, 1970 now abandoned.

My invention relates to laboratory equipment and more particularly to measuring and dispensing devices known as pipettes.

Pipettes basically involve a tube of glass having a narrowed or restricted tip at one end and a soft or flexible bulb of rubber assembled onto the opposite end. Aside from the fact that glass is fragile and must be handled with care, it is wettable by liquids and consequently, the tendency of liquids to adhere thereto may result in a film or droplets adhering to the inner wall and outer wall of the tip, following discharging of the contents of the pipette. While the volume of liquid involved in such film or droplets may appear quite small, it must be kept in mind that pipettes may be designed to handle quantities measured in micro-liters (millionths of a liter), and percentagewise, such residual liquid clinging to the walls of the pipette, could introduce unwanted errors.

In addition, rubber bulbs are opaque, and consequently, measurements to the full capacity of the tube are not determinable with accuracy. Accordingly, in some cases, an indication is placed on the observable portion of the tube, to indicate a fixed or predetermined volume which may be measured by observation with a reasonable degree of accuracy, depending on the care exercised, but this obviously cannot assure uniformity of results.

Among the objects of my invention are;

1. To provide a novel and improved pipette;
2. To provide a novel and improved pipette of non-wettable material such as plastic;
3. To provide a novel and improved pipette in which the bulb is integral with the tube;
4. To provide a novel and improved pipette in which full capacity of the tube may be utilized without the exercise of appreciable care;
5. To provide a novel and improved pipette which may be fabricated so economically as to render it a disposable item;
6. To provide a novel and improved pipette which lends itself to being molded with the bulb integral with the tube;
7. To provide a novel and improved pipette in which the bulb is clear or translucent and integrally united with the tube;
8. To provide a novel and improved pipette capable of being adjusted as to capacity.

Additional objects of my invention will be brought out in the following description of a preferred embodiment of the same, taken in conjunction with the accompanying drawings wherein.

Figure 1:
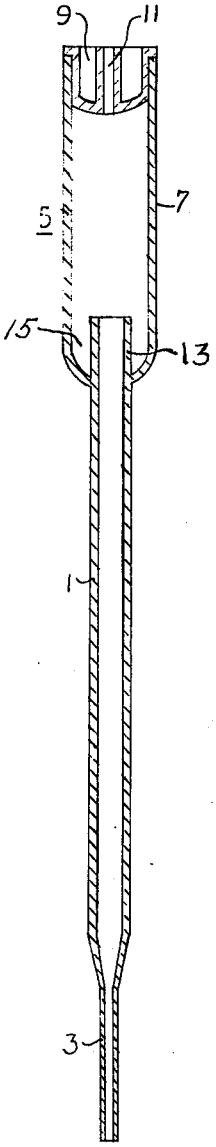
FIG. 1 is a view, in section, through a pipette of the Pasteur or transfer type, embodying the present invention.

Referring to the drawings for details of my invention in its preferred form, the same involves a tube 1 of plastic, which may include a narrowed or restricted tip 3 at one end, and integrally united with the tube at its other end, is a bulb 5 of preferably similar material, the bulb comprising a cylindrical portion 7 of greater diameter than the tube to which it is integrally united. The open or free end of the cylindrical portion is spanned by a frictionally fitting plug or cap 9 having a vent opening 11 therethrough, controllable by the use of one's finger.

Preferably, the tube 1 extends into the bulb 5 a short distance, to form an extension 13 and provide a catch basin 15. This construction imparts an important advantage, in that the total tube including the extension, may now be utilized as a precise measuring unit, for, by drawing in sufficient liquid to produce a slight overflow, the excess will spill over into the catch basin, and only that volume within the tube may be discharged upon squeezing the bulb. Thus a precise and exact measurement of liquid can be realized and without the exercise of appreciable care.

To utilize this feature to maximum advantage, the bulb and tube may be made of a clear or translucent plastic, whereby one may, by casual observation, limit the extent of overflow.

An additional and extremely important feature of the present invention, lies in the fact that by adding a cap to finish off the bulb, it permits of the bulb and tube being molded integrally and with the extention 13, for it is essential in molding a product of this character, that the corepins be removable, and the present design allows for this.

The importance of this lies in the fact that the units may now be fabricated of moldable material such as plastic, and so economically as to place them in the category of disposable items.

And inasmuch as clear or translucent flexible plastic is available, the ability to make the bulb of such material becomes of paramount importance.

In molding the bulb integral with the tube, not only will leakage at this point become an impossibility, but it renders it impossible to remove the bulb for use with another tube, which practice could conceivably lead to contamination.

Figure 2:
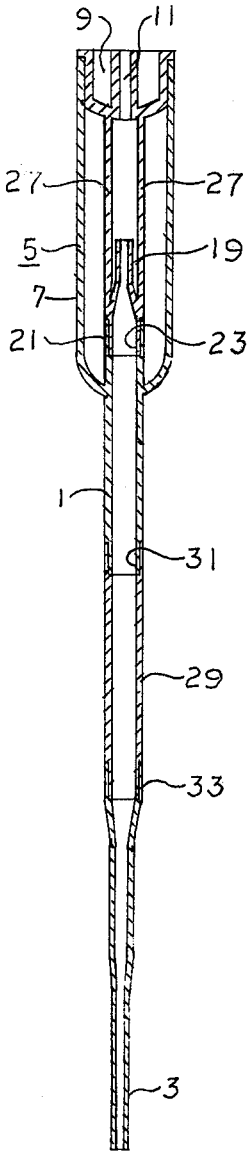
FIG. 2 is a view, in section, depicting the invention as embodied in a pipette of the micro-liter type.

In FIG. 2 is depicted a pipette or the micro-liter type embodying the features of the present invention, and one which is capable of being molded in the same manner as the embodiment of FIG. 1.

A pipette of the micro-liter type, being one designed to dispense exceedingly small quantities of liquid, measured in the millionths of liter, it will normally have a very small diameter bore within the narrowed or restricted discharge end 3 of the tube, and the tube will also, at its opposite end within the bulb, be provided with a narrowed or restricted tip 19 having a very small diameter bore, to assure capillary retention of liquid in the tube until forced out by squeezing of the bulb.

In the embodiment under consideration, the inwardly extending end 21 of the tube 1 will be molded with an enlarged inside diameter, and the narrowed or restricted tip 19 for use at this end of the tube, will be molded separately and with a neck 23 of reduced outside diameter to provide a friction or telescoping fit with the end 21, for assembling the one to the other.

To reduce the number of molding operations, this restricted end tip 19 may be molded integral with the vented plug or cap 9 by forming therewith two or more stiff connecting free ribs 27, or in lieu thereof, one might mold a cylindrical connecting screen joining the cap and restricted end tip into a unitized assembly.

In this embodiment, an accurate and precisely measurable volume of liquid is represented by the volume of the tube 1 including both of its narrowed or restricted ends, and by drawing in sufficient liquid to provide overflow into the bulb, such precise measurement will be realized without the exercise of any degree of care. Where fractional portions of the contents, are to be dispensed, the tube may be calibrated.

In connection with this embodiment of the invention, is depicted a means for increasing the capacity of the pipette, through the insertion of one or more tube segments 29 preferably of calibrated volume, whereby the ultimate capacity of the pipette may be readily determined.

For this purpose, the discharge tip portion of the tube is molded as a separate element and adapted to be removably secured to the tube proper by a frictional connection, as by molding the free end 31 of the tube proper, to a reduced outside diameter and molding the attachable end 33 of the discharge tip portion of the tube with a complementary increased inside diameter, to permit telescoping the one to the other with a frictional fit. By molding the installable intermediate sections 23 with corresponding mating ends, one or more of such intermediate installable sections may be added, to correspondingly increase the overall capacity of the pipette. When so increased, the joint lines may function as graduations to enable volume determinations.

In this connection, however, one may not desire to rely exclusively on a frictionl fit, to retain the elements in leakproof assembled relationship, for should the components not be assembled all the way or should one or more of the joints be accidently forced from a total mating relationship, the calibration of the pipette will be to that extent upset.

Accordingly, I provide a locking feature, which will lock the various components in their assembled leakproof relationship, and only when such relationship results in a full mating of the components.

Such locking means may take the form of an internal rib 37 at the extreme edge of one element and a complementary groove 30 in the mating end of an adjacent element, into which groove the rib will snap, and then only when the mating ends are in full mating relationship.

Preferably, the spacing of the rib from the full thickness portion of its associated component is made very slightly less than the corresponding distance of the groove from the end of its associated component, whereby, upon snapping of the rib into the groove, a prestressed condition will exist, assuring maintained pressure engagement between the facing ends of the mating components. Such lock may be applied to cap 9.

Figure 3:
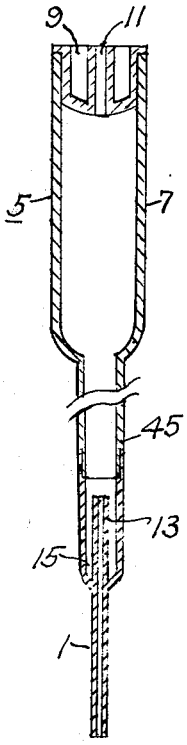
FIG. 3 is a view, in section, through a pipette of the present invention adapted for accurate removal of a predetermined minute quantity of liquid from deep within a narrow receptacle such as a test tube.
Figure 4:
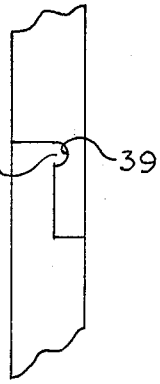
FIG. 4 is a view depicting a lock feature employable in the assembly of a pipette of the present invention.

The embodiment of the invention illustrated in FIG. 3 is capable of accurately handling liquid in extremely small volumes, and is designed to permit removal and transfer of such volume from deep within a narrow receptacle, such as a test tube, for example, without the necessity of first tilting such receptacle to bring its contents close to the mouth thereof, as is required with some pipettes. Likewise it enables convenient discharge of minute volumes of liquid to the lower region of deep narrow receptacles without wetting the walls of such receptacles.

Toward this end, the bulb 5 may include a bottom extension 45 of smaller diameter, capable of entering the narrow receptacle from which liquid is to be withdrawn or into which liquid is to be discharged. This bulb with its bottom extension may be molded integral with the tube 1 in the manner of the pipette of FIG. 1. For minute volumes, the tube 1 of FIG. 3 will be small and have a small bore.

Where it might be desirable to render the bottom extension 45 adjustable as to length, it might be separable and segmented along the lines described in connection with tube 1 of the embodiment of FIG. 2, whereby segments may be inserted to the number required to realize the length desired.

The construction of the embodiment of FIG. 3, places no limitation as to the volume of the tube 1. Accordingly this tube can be a capillary tube and of varying degrees of length and internal diameter and where the bulb extension 45 is separable, tubes of different volume may be selectively utilized to satisfy different requirements.

When the pipette of the present invention is of a nonwettable plastic such as teflon, polypropylene, polyethelene, etc., liquid will not adhere thereto. This assures complete discharge of the contents of the tube portion of the pipette, and this could become a very important factor from the viewpoint of accuracy, particularly where minute volumes are involved.

From the foregoing description of my invention in its preferred form, it will be apparent that the same is subject to some alteration and modification without departing from the underlying principles involved, and I accordingly do not desire to be limited in my protection to the details of my invention as illustrated and described but desired to include all equivalents thereof.

I claim:

1. A pipette comprising a tube of plastic and a bulb of flexible plastic, said bulb including a bottom extension of smaller diameter and being integrally united to said tube at the lower end of said bottom extension.

2. A pipette in accordance with claim 1, characterized by said bottom extension being separable.

3. A pipette comprising a tube of plastic and a bulb of greater average diameter than said tube, said bulb being of flexible plastic in axial alignment with and integrally injection molded with said tube adjacent an end thereof and in flow relationship therewith, whereby to form a molded one piece unitary structure with a continuous and uninterruptable connection between said tube and said bulb.

4. A pipette in accordance with claim 3, characterized by said flexible bulb having a vent opening at a location conveniently accessible to one's finger while said pipette is in use.

5. A pipette in accordance with claim 3, characterized by said bulb including a substantially cylindrical wall, said cylinder wall being integrally molded with said tube to form said unit device, said cylindrical wall being left with a free end, and a cap at the free end of said cylindrical wall.

6. A pipette in accordance with claim 3, characterized by said cap having a vent opening therein.

7. A pipette comprising a tube of plastic and a bulb of greater average diameter than said tube, said bulb being of flexible plastic in axial alignment with and integrally molded with said tube adjacent an end thereof and in flow relationship therewith, whereby to form a molded one piece unitary structure with a continuous and uninterrupted connection between said tube and said bulb, said tube including an extension into said bulb to provide an overflow catch basin and said bulb having a volume exceeding that of said tube to enable overfilling of said tube, and being at least partially transparent to enable to observe overflow into said catch basin.

8. A pipette in accordance with claim 7, characterized by a tapered tip installed on the end of said extension within said bulb.

9. A pipette comprising a tube of plastic and a bulb of greater average diameter than said tube, said bulb being of flexible plastic in axial alignment with and integrally molded with said tube adjacent an end thereof and in flow relationship therewith, whereby to form a molded one piece unitary structure with a continuous and uninterrupted connection between said tube and said bulb, said tube including at least two assembled sections, connectible in end to end relationship by interfitting ends forming a leak proof connection, and means for increasing the length of said pipette.

10. A pipette in accordance with claim 9, characterized by said leak proof connection including an outer telescoping end on one section and an inner telescoping end frictionally fitting said outer telescoping end, said inner telescoping end having a circumferential channel and said outer telescoping end having an inwardly facing circumferential rib adapted to snap into said channel upon telescoping the ends of adjacent sections, and further characterized by said means for increasing the length of said pipette as including a third section having one end formed to provide a complementary fit with the interfitting end of one of said two sections, and having its other end formed to provide a complementary fit with the interfitting end of the other of said two sections.

11. A pipette comprising a tube of precalibrated capacity and of non-wettable material, a catch basin surrounding said tube adjacent an end thereof and forming a unitary structure therewith, and a partial bulb of flexible and at least partially transparent material, adapted for removable attachment to said catch basin to complete said bulb and enable interchangeability of said tube with others of like or different calibration whereby upon filling any such tube to overflowing as observable through said bulb, an accurate volume equal to the precalibrated capacity of said tube can be realized.

* * * * *